United States Patent [19]

Tillner et al.

[11] Patent Number: 4,675,962

[45] Date of Patent: Jun. 30, 1987

[54] METHOD AND APPARATUS FOR FITTING COVERS TO BODY STRUCTURES

[76] Inventors: Alfred Tillner, Richtstättenweg 1a, D-4513 Belm, Fed. Rep. of Germany; Conny Hedenberg, Slädvägen 10, S-564 00 Bankeryd, Sweden

[21] Appl. No.: 777,537

[22] Filed: Sep. 19, 1985

[30] Foreign Application Priority Data

Sep. 20, 1984 [SE] Sweden ..... 8404706

[51] Int. Cl.[4] ..... B68G 7/00

[52] U.S. Cl. ..... 29/91.1; 29/91.5; 29/235; 29/451

[58] Field of Search ..... 29/91.5, 451, 91.1, 29/235, 91.7, 91.8, 238

[56] References Cited

U.S. PATENT DOCUMENTS

| | | | |
|---|---|---|---|
| 958,011 | 5/1910 | Rothberg | 29/91.5 |
| 3,438,108 | 4/1969 | Nash | 29/91.5 |
| 4,385,427 | 5/1983 | Fraiser | 29/91.5 |

FOREIGN PATENT DOCUMENTS

| | | | |
|---|---|---|---|
| 2151966 | 11/1972 | Fed. Rep. of Germany | 29/91.5 |

*Primary Examiner*—Charlie T. Moon

*Attorney, Agent, or Firm*—Browdy and Neimark

[57] ABSTRACT

An apparatus for fitting a cover to a body structure comprises a main frame; a first body-holding assembly mounted in the main frame, and a second body-holding assembly mounted in the main frame in spaced relationship with the first body-holding assembly. The first body-holding assembly includes an upwardly open, first body-holder means which has at least two mutually opposite and mutually spaced side surfaces and which is intended to receive and to hold one end of the body structure. When fitting a cover to a body structure, the first holder means has draped therearound an inverted back-like cover to be fitted to the body structure. Pressing means are arranged adjacent each of the side surfaces of the first holder means and are arranged for vertical movement in a direction towards the second body-holding assembly while undraping the cover and fitting the same around the defining surfaces of the body structure. The other end of the body structure is held detachably in the second body-holding assembly, which upon movement towards the first body-holding assembly causes the body structure to pushed firmly into the first, upwardly open holder means while entraining and turning part of the inverted cover thereinto.

14 Claims, 5 Drawing Figures

44
30
32
14
46
48
36
32
34
10
38
34
42
40
38
28
42
40
28
82
101
15
15'
84
100
12
16
78
86
18
80
56
52
74
76
101
74
76
72
50
62
66
60
68
70
26
70
20
24
68
22
58
64
66
50
20

Fig. 3
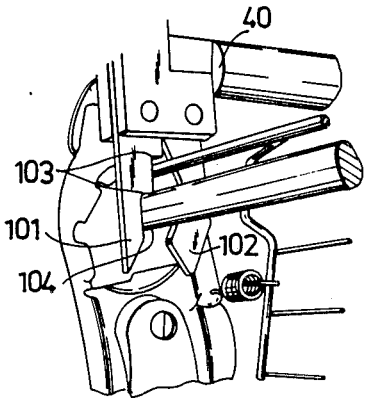
Fig. 4
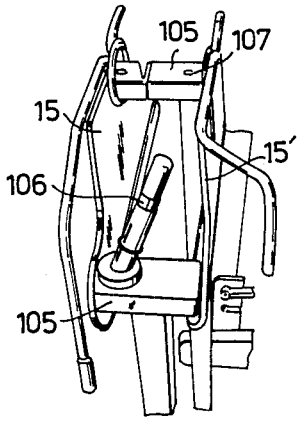
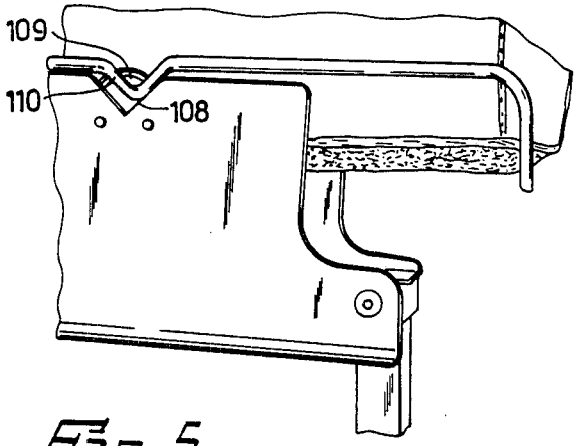
Fig. 5

METHOD AND APPARATUS FOR FITTING COVERS TO BODY STRUCTURES

The present invention relates to apparatus for fitting covers to body structures, and particularly, although not exclusively, to back-rests of vehicle seats, and also to a method for fitting covers to such body structures by means of the apparatus.

The fitting of covers to vehicle seat back-rests in particular presents a number of serious problems, due mainly to the fact that such back-rests are curved or arched in two directions, i.e. in the lateral and vertical directions. Curvature along the vertical axis of such back-rests is also irregular, in order to accommodate the shape of the back of the seat occupier. As a result hereof no method has been devised hitherto for fitting covers to the back-rests solely with the aid of mechanical means. Consequently, it has been necessary to pull the normally tightly fitting covers onto the back-rests manually, a task which is both difficult and laborious. Furthermore, in addition to also being costly, the work involved also presents the risk of personal injury, due to the uncomfortable working positions which must be adopted, the heaviness of the work involved, and the force which needs to be exerted by the craftsman involved.

An apparatus for fitting furniture coverings to furniture components in which a major part of the work involved is effected mechanically is known from French Patent Specification No. 2 027 533. This known apparatus incorporates the use of a cassette-like device, over which an inverted furniture cover is draped and into which a furniture component is fully pressed with the aid of piston-cylinder motors, so as to entrain the inverted cover and turn the same so that the right side faces outwards. The cassette-like device is, to this end, divided into several parts and is provided with movable components, in order to accommodate profiled furniture components, i.e. components of irregular shapes and forms, which applies practically to all furniture components. This apparatus, however, cannot be used to fit snugly fitting covers where the material has no significant stretch, particularly when the furniture components concerned present highly irregular shapes and forms, for example alternately taper, widen, transform to convex surfaces and then to concave surfaces, etc.. In this case, the cassette components are first guided over the outwardly projecting furniture component parts, without allowing the cover to follow the contours of subsequent tapering furniture-component parts. The cassette components are also hinged on one or two common pivot axes, which for the aforesaid reasons is highly unsuitable, particularly as the said components are straight. It can also be to disadvantage to place the furniture components in different height positions and to then remove said components subsequent to covering the same. This does not allow the work of fitting covers with the aid of this machine to be automated, for example. Another disadvantage with this known apparatus is that the covered furniture components must first be raised vertically from a low-lying position in order to enable them to be lifted from the cassette-like device, which is a tiring and strenuous task. It would also appear difficult, if not impossible, to fit supplementary fittings, i.e. fittings which lie outside a cover, with the aid of this apparatus. Still another disadvantage with this known apparatus is that the task of modifying the apparatus to accommodate different types of furniture would undoubtedly be expensive and time consuming, if at all possible.

Accordingly, a primary object of the invention is to provide an apparatus for fitting covers to body structures fully mechanically, i.e. with no manual contribution.

A further object is to provide such an apparatus which is simple to operate and highly reliable in operation, and which can be manufactured at low costs.

Another object is to provide such an apparatus which can be readily modified to accommodate mutually different body structures.

These and other objects are achieved by means of an apparatus according to the invention, which comprises a main frame; a first body-holding assembly mounted in the main frame and incorporating an outwardly open first holder means which has at least two mutually opposite and mutually spaced upstanding sides and which is intended to receive and hold one end of said body structure, said first holder means being intended to have draped therearound an inverted bag-like cover to be fitted to the body structure; a second body-holder assembly mounted in said main frame in vertical spaced relationship with said first holder assembly and intended to hold the other end of the body structure; and pressing means arranged adjacent each of the said upstanding holder sides and being vertically movable in the direction of the vertical extension of said upstanding sides, towards and away from said second body-structure holder assembly and operative to undrape the cover from the first holder means and press said cover against respective sides of said body structure during upward movement of said pressing means. The pressing means are suitably controlled to ensure that they follow the contours of the body structure and therewith tightly fit the cover therearound.

So that the invention will be more readily understood and other features thereof made apparent exemplifying embodiments of the invention will now be described with reference to the accompanying drawings, in which FIG. 1 is a perspective view of an apparatus constructed in accordance with the invention;

FIG. 2. illustrates in larger scale a detail of the apparatus shown in FIG. 1, this detail incorporating the pressing means and devices for operating said pressing means;

FIG. 3 illustrates a preferred embodiment of a holder assembly; and

FIGS. 4 and 5 illustrate preferred embodiments of a cassette and pressing means in two different views.

For reasons of clarity the drawings do not show the hoses and pipe lines required to supply working medium to the various piston-cylinder motors. Neither do the drawings show the various stop means and limit switches provided for controlling assembly travel.

Figure 1:
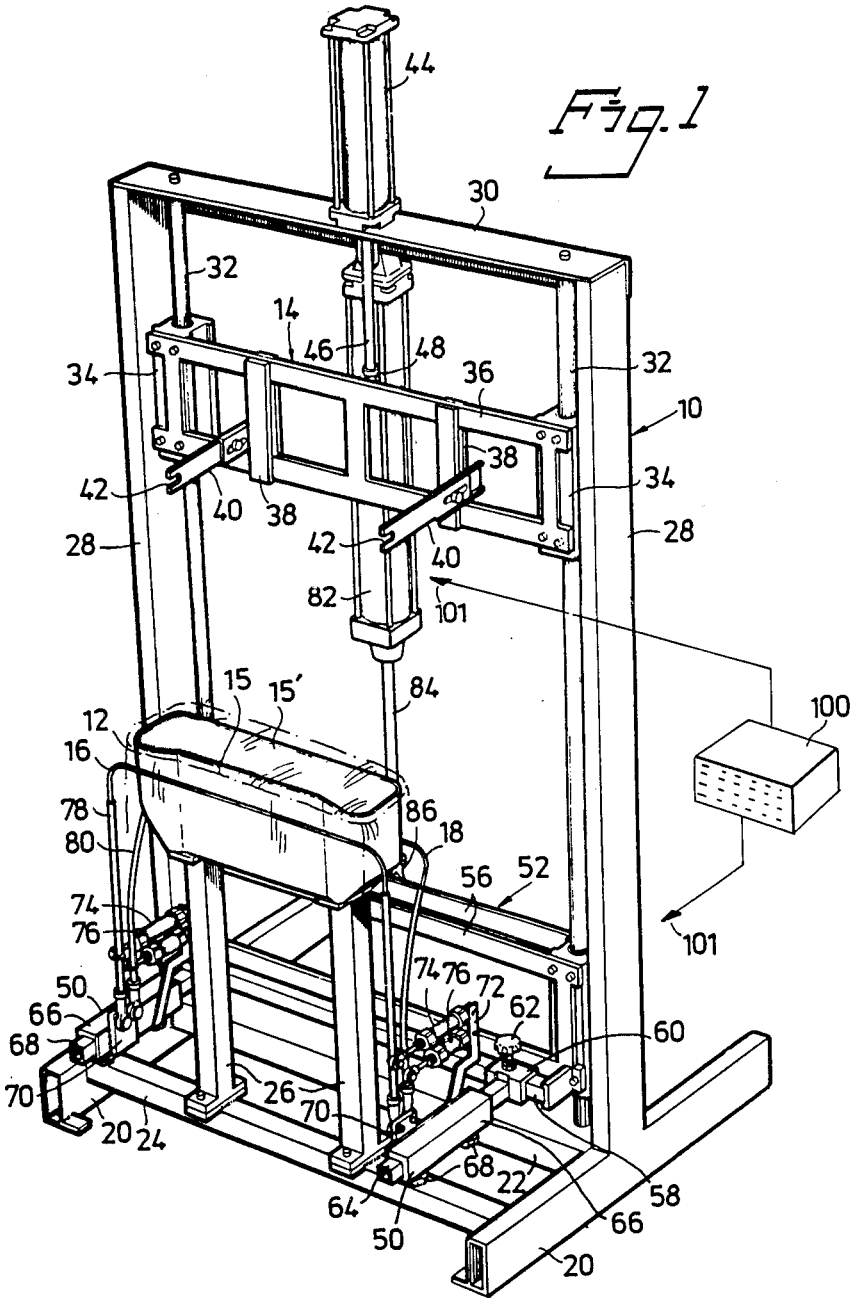
Figure 2:
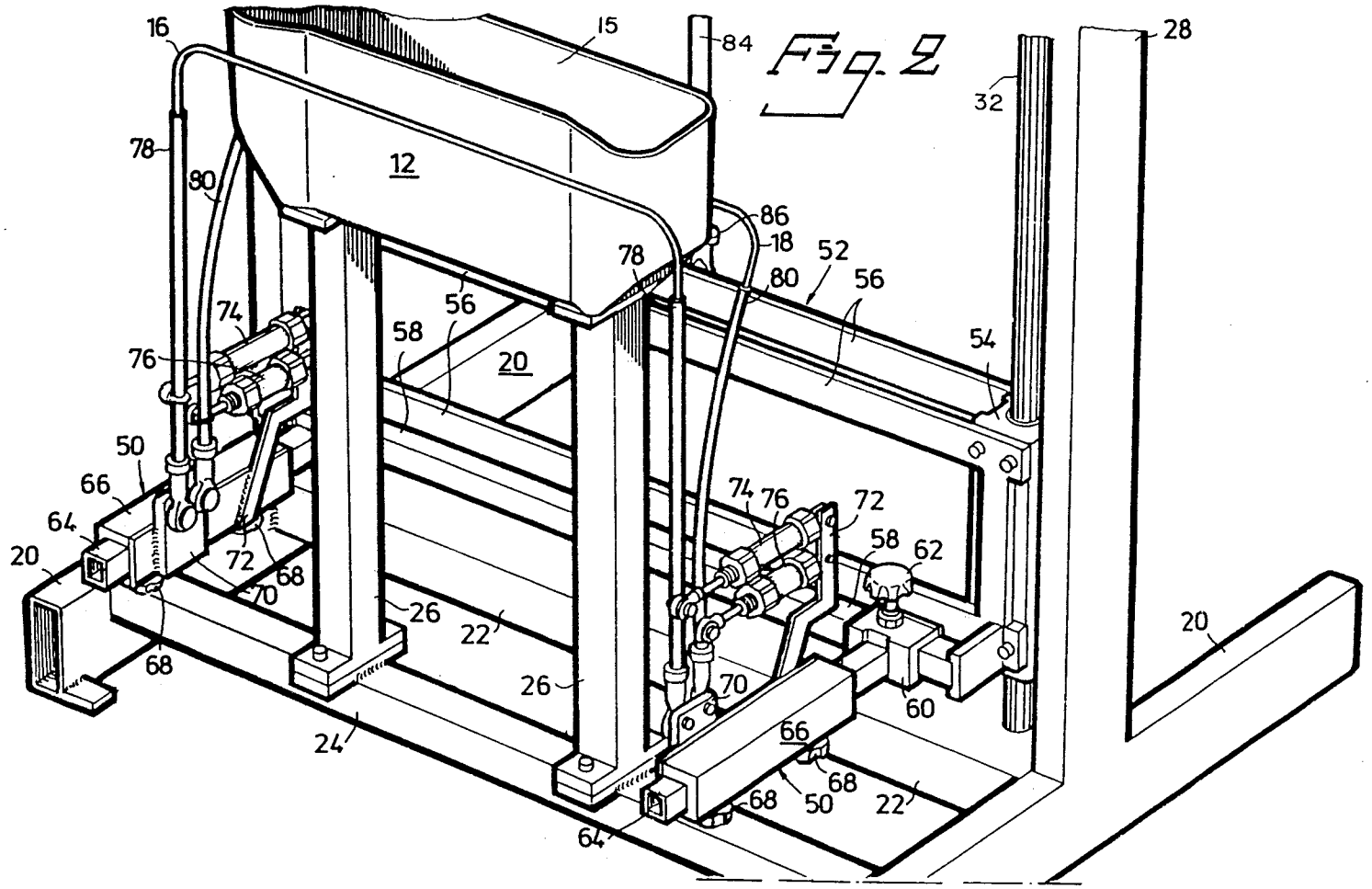

Turning now to the drawings, there is shown in FIGS. 1 and 2 a first embodiment of an apparatus constructed in accordance with the invention for fitting bag-like seat coverings to the seats of automotive vehicles. The illustrated apparatus comprises a main frame structure 10, a first back-rest locating and holding assembly 12 operative to hold and locate one end of a seat back-rest in the apparatus, a second back-rest locating and holding assembly 14 which is operative to hold and locate the other end of the back-rest and which is movable towards and away from the first assembly 12 in a manner hereinafter described, and pressing means in the form of inverted U-shaped press-stirrups 16,18 arranged forwardly and rearwardly of an upwardly open, elongated hollow back-rest support 15 which forms part of the first assembly 12 and which is hereinafter referred to as the cassette 15. The main frame structure 10 comprises two mutually spaced, horizontal supporting and mounting bars 20, which are connected together by a transverse bar 22 and a cross-brace 24. Mounted in mutually spaced relationship on the cross-brace 24 are two upstanding posts 26, which carry the aforesaid cassette 15. Extending vertically from respective mounting bars 20 are two side posts 28, which are joined at the tops thereof by a cross-member 30. Extending vertically adjacent respective side posts 28 are two guide rods 32, along which the second assembly 14 and the inverted U-shaped press-stirrups 16,18 are arranged to move in a manner hereinafter made apparent. The second back-rest holding and locating assembly 14 of the illustrated embodiment comprises a frame structure in which two mutually parallel, horizontal and mutually spaced slide rails 36 have mounted on respective ends thereof a guide-shoe 34 which engages a respective guide rod 32 for vertical movement therealong. Mounted on the slide rails 36 for sliding movement therealong are two slide-shoes 38, said slide-shoes being lockable in selected positions on the slide rails 36 by means of locking devices not shown. Each slide-shoe 38 is provided with means for detachably attaching thereto a holder 40, this holder being arranged for movement along its associated slide-shoe 38 extending vertically between the slide rails 36. The holders 40 are each provided with means by which an uncovered back-rest can be attached to the vertically movable assembly 14, these means in the illustrated embodiment having the form of recesses or notches 42. Vertical movement of the second back-rest holding and positioning assembly 14 along the guide rods 32 is effected by means of a piston-cylinder motor 44 on the cross-member 30 of the main frame 10. The second assembly 14 of the illustrated embodiment is connected to the piston rod 46 of the motor 44 by means of an attachment device 48 which is adapted to enable the assembly 14 to be attached at selected positions along the length of the piston rod 46, so that the position of the assembly can be adjusted to accommodate back-rests of mutually different heights.

As will be seen more clearly from FIG. 2, each of the inverted U-shaped press-stirrups 16,18 is connected at its ends to a respective mounting assembly generally shown at 50, each said mounting assembly being arranged for vertical movement along respective guide rods 32 in a manner hereinafter made apparent. The assemblies 50 each comprise a hollow beam 66 of rectangular cross-section, in which there is arranged a coaxial bar 64 of similar cross-section, said bar being slideable axially in the hollow beam 66. The hollow beam 66 is connected at one end thereof to a carriage assembly generally referenced 52, said carriage assembly comprising a horizontally extending twin-frame structure 56, having mounted on its outer ends slide shoes 54 which engage a respective guide rod 32 for movement of the carriage assembly therealong. Connected to the twin frame structure 56 and extending horizontally between the slide-shoes 54 in parallelity with a lower frame member of said structure is a free-lying bar 58 of rectangular cross-section, on which two sleeve-like connectors 60 are slideably arranged, each of said connectors being provided with a locking screw 62 for locking the connector in a set position on the bar 58. These connectors 60 are intended to receive the end of a respective bar 64 extending co-axially in the hollow beams 66 and axially slideable in relation thereto, said bars being locked in selected axial positions by means of a respective lock bolt 68.

Each of the hollow beams 66 has attached thereto a mounting plate 70 to which the ends of the inverted U-shaped press-stirrups 16,18 are pivotally mounted, the stirrup 16 being located forwardly of the cassette 15 and the stirrup 18 rearwardly thereof. Connected to each mounting plate 70 in a suitable manner not shown is a bracket means 72, each of which carries a respective pair of piston-cylinder motors 74, 76, the piston rods of which are connected to respective press-stirrups 16,18 for activation thereof. Thus, the piston rods of motors 74 are connected to the forwardly located press-stirrups 16, and the piston of motors 76 are connected to the rearwardly located press-stirrup 18, the forwardly located press-stirrup means of this embodiment constituting a true pressure-exerting means, as will be apparent hereinafter. As clearly shown in FIGS. 1 and 2, each press-stirrup 16,18 comprises an inverted U-shaped rod the legs of which are removably inserted in respective elongated, upstanding pairs of sockets 78, these sockets being connected to the aforesaid laterally slideable hollow beams 66 and to respective piston rods of the motors 74,76. Thus, when wishing to cover a back-rest whose width differs to the width for which the machine is set, the press-stirrups 16,18 can be simply removed from their respective sockets 78 and the mounting assemblies 50 moved laterally along the bar 58 to appropriate positions thereon, whereafter after the sleeves 60 of respective attachment arrangements are locked in their set positions by the lock screws 62, and fitting stirrups are inserted. The assembly comprising the U-shaped press-stirrups 16,18, the two mounting assemblies 50 and the carriage means 52 is arranged to be moved vertically along the guide rods 32 by means of a piston-cylinder motor 82 attached to the crossmember 30. The piston rod 84 of the piston-cylinder motor 82 is attached to the carriage 52 by means of an attachment 86 in a manner which enables the position of the carriage to be adjusted in the axial direction of the piston rod.

The illustrated apparatus has the following mode of operation. An open-ended, bag-like seat covering is first inverted, i.e. turned inside out, and then draped over the cassette 15 and the two inverted U-shaped press-stirrups 16,18. One end of a back-rest is then placed in the cassette 15 and the other end of said back-rest is firmly connected to the holders 40. These holders may be constructed in a manner which enables them to co-act in a fastening fashion with existing mounting elements on the back-rest of a vehicle seat. Suitably, the holders are provided with back-rest quick-fastener means (not shown), such as to allow the back-rest to be displaced longitudinally without moving free of the holders. Such quick-fastener means may take the form of different spring-loaded latching means, or may quite simply comprise a widening of the inner part of the recesses or notches 42. The provision of such fastener means obviates the laborious task of screwing the back-rest to the holders.

The double-acting piston-cylinder motor 44 is now activated, whereupon the piston rod 46 thereof extends and moves the second holding assembly 14 down the guide rods 32 and towards the first holding assembly 12, therewith moving the back-rest (not shown) into the cassette 15 until it bottoms therein. As the back-rest moves into the cassette it pulls the seat cover down thereinto, such that the cover is again inverted and fitted around that part of the back-rest located in the cassette. The other double-acting piston-cylinder motor 82 is then activated, whereupon the piston rod 84 is withdrawn and moves the carriage 52, the mounting assembly 50 and the press-stirrups 16,18 towards the other end of the back-rest. The piston-cylinder motors 74 then draw the forwardly located press-stirrup 16 in against the forwardly facing side of the back-rest, and the piston-cylinder motors 76 press the rearwardly located press-stirrup 18 out against the rear side of the back-rest. The stirrups 16,18 are herewith located in the fold of material between the fitted part of the cover and the downwardly draped loose part thereof, and continue to turn the cover to its right side in during their continued movements towards the other end of the back-rest, so that when the piston rod 84 is fully withdrawn, the cover is fitted to the back-rest with the right side of the cover facing outwards.

Subsequent to thus fitting the cover to the back-rest, the piston-cylinder motor 82 is switched to its reverse mode, whereupon it draws the press-stirrups 16,18 back to their starting positions adjacent the cassette 15. The motor 44 is then switched to its reverse mode, whereupon the covered back-rest is withdrawn from the cassette 15. The thus covered back-rest is then detached from the holders 40 and removed from the apparatus and the aforedescribed cycle repeated.

Since the side of the back-rest against which the forwardly located stirrup 16 bears arches away from the stirrup, such arched configurations being normal in vehicle seats, it is particularly important that the stirrup is pressed hard against the back-rest with a sustained force. It has been found that pneumatically operated pressure-exerting piston-cylinder motors are particularly suitable for this purpose, since such a motor is able to sustain a constant pressure force irrespective of the position of the stirrup. Since the rear side of the back-rest arches out towards the rearwardly located stirrup 18 the demands on the pressure exerted by the stirrup 18 and the working motors 76 are not as stringent as those made with regard to the stirrup 16. Consequently, the working motor 76 may operate at lower working pressures, and/or may have smaller cylinder diameters than the working motors 74, or may be replaced with simpler force exerting means, such as springs for example.

The cover fitting apparatus according to the invention can be used to cover back-rests of mutually different widths. When wishing to adapt the apparatus to a back-rest whose width is different to that for which the apparatus is setup, the cassette 15 and the press-stirrups 16,18 at present installed are replaced with a cassette and stirrups which correspond to the new width, and the sleeves 60 are moved to corresponding positions on the bar 58. The side-shoes 38 and the holder 40 on the frame 36 are also moved horizontally to positions which correspond to the new width. The holders 40 may also be exchanged for other holders which co-act more readily with the new back-seats to be covered. The first back-rest holding and positioning assembly 14 is also adjusted vertically with the aid of attachment means 48, if necessary, in order to correspond with the length of the new back-rest. The press-stirrups 16,18 may also be adjusted vertically with the aid of attachment means 86, if found necessary.

The described and illustrated embodiment of the cover fitting apparatus according to the invention is operated with the aid of a number of piston-cylinder motors, preferably pneumatic motors. These motors are preferably operated in sequence from a control centre, so that subsequent to placing a back-rest cover and a back-rest in position in the apparatus, all working steps are carried out in the correct sequence upon activation of a single start control.

The apparatus can also be operated with the aid of hydraulic piston-cylinder motors and other drive means, for example electric motors. Manual operation through the agency of levers and/or pedals is also conceivable. It is also possible to use any combination of drive sources in the operation of the cover fitting apparatus according to the invention. For example, the motors 82, 44 driving the mounting assemblies 50, together with stirrups 16,18, and the second back-rest holding assembly 14 respectively may be pneumatic motors, and the stirrups may be pressed against respective sides of the back-rest by force-generating means other than the illustrated and described piston-cylinder motors 74,76, for example by spring forces or suitable counter weights.

Neither need the stirrups have the form of an inverted U, but may, for example, be curved or arched so as to follow the contours of the back-rest being covered. The stirrups may also be replaced with a plate shaped to follow the contours of the back-rest and provided with means for attaching the plate to the laterally displaceable sockets 78,80. It will also be understood that the legs of the stirrups need not necessarily be located adjacent the edge regions of the back-rest, but may also be located inwardly thereof, so as to follow the front and back surfaces of the back-rest, in which case part of the stirrup will project laterally beyond the legs. Stirrups of this configuration, however, are less suitable, since the horizontal parts of the stirrups must be capable of following the contours of the back-rest throughout the whole of their movement, and hence stirrups in which the legs thereof are located at the edge regions of the back-rest are to be preferred.

In FIG. 1 the apparatus according to the invention is shown in an upright position with the cassette 15 located at the lower end of the back-rest. It will be understood, however, that the apparatus may also be placed in a horizontal position. The apparatus is then suitably provided with a back-rest support, which is automatically disengaged when the back-rest is inserted into the cassette. The apparatus may also be placed in an upright position with the cassette directed upwardly or in some other position.

The pressure-exerting piston-cylinder motors, and particularly the motors 74, are also suitably double-acting motors. This enables the stirrup 16 to be moved away from the back-rest subsequent to fitting the cover therearound, so that said stirrup 16 does not lie against the back-rest during its return movement to its starting position.

The cover-fitting apparatus also suitably incorporates stop means for limiting travel of the second holder assembly 14 and the press-stirrups respectively. These stop means may suitably be arranged in connection with the guide rods. Limit switches may also be arranged to advantage at desired limit positions of the various movements. These limit switches may be arranged to initiate a starting signal for stopping travel and/or starting a new travel sequence. Such limit switches may suitably be incorporated in a sequence control system for two or more working stages. The provision of such limit switches and other sequence control-means enables a cover to be fitted completely in one single working sequence without requiring intervention on the part of the workman involved.

FIG. 3 illustrates a preferred embodiment of the holders 40. These preferred holders are provided with downwardly directed claws or like bifurcate gripping devices 101, 102, which are provided on mutually facing surfaces with shoulders 103 and beveled edges 104 which enable the transverse rod of a seat-rest to be held firmly and securely. At least one of the claw arms is pivotable in a known manner and actuable by a spring and/or a pressure-medium operated piston-cylinder device (not shown), which holds the body-structure or seat-rest firmly during the working process and which is released at the end of said process, whereupon the said at least one pivoted claw arm is swung away.

FIGS. 4 and 5 illustrate a preferred form of the cassette 15 and the press-stirrups 16,18. In this preferred embodiment the cassette comprises solely a front and a back side 15,15', leaving the narrow sides of the cassette open. The front and back sides of the cassette are joined together by a bottom member, which may optionally solely comprise two spacers 105 on which, for example, guide sleeves 106 for head and neck supports can be advantageously arranged in positioning devices 107. When fitting covers provided with openings for accommodating these sleeves, the sleeves are guided through the openings and pressed automatically thereinto upon downward movement of the body-structure or back-rest. In order to provide easy access to the positioning devices, the upper corners of the cassette sides may be cut away, as illustrated in FIG. 5.

As also shown in FIG. 5, the cassette sides are provided centrally thereof with, for example, a V-shaped recess 108 which presents a shoulder 109 on the inside of respective cassette sides. The horizontal section of each press-stirrup presents a corresponding bend 110 which fits into an associated recess 108. When occupying their starting positions the two press-stirrups are forced against a respective shoulder 109 by means of spring-devices (not shown), wherewith the said two horizontal stirrup sections lie inwardly of the vertical planes of the two cassette sides. When the press-stirrups comprise round-rod, the stirrups will slide against the cover without appreciable contact with the sides of the cassette. This ensures a perfect starting position and low friction.

FIG. 4 illustrates a press-stirrup embodiment which enables the stirrups to be adapted to different forms of body structures. By commensurate bending etc. of the press-stirrups, the stirrups can be made to follow diligently any desired body-structure configuration in close abutment therewith in the absence of appreciable friction and tension, thereby enabling covers of particularly tightly fitting materials to be used, which is highly desirable when covering, for example, the back-rests of automotive vehicles. An important advantage is afforded when the horizontal sections of the stirrups and the stirrup legs are made exchangeable, such that the stirrup legs can be readily inserted into or pushed upon the preferably straight, pivotable stirrup-leg sockets attached to the mounting assemblies.

The invention also enables further, advantageous auxiliary fittings to be mounted in a ready and simple manner in comfortable working positions, in which the personnel concerned need never stoop or carry out heavy working movements. For example, upward movement of the press-stirrups can be stopped at desired height levels at which the one side of the cover can be readily joined to the other side thereof, this being effected, for example, by connecting cross-stays sewn into the inside of the cover with corresponding cross-stays on the other side of said cover with the aid of hook fasteners or the like.

The correctly positioned flat stationary cassette affords a particular advantage. The cassette serves as an abutment and securing means for a body-structure to be covered, whereas the stirrups are practically alone responsible for fitting the cover to the body structure. The cover is able to extend inwardly of a press-stirrup, as illustrated for example in FIG. 4, and the tightest fitting covers can be fitted to the most complicated body structures with the minimum of friction.

We claim:

1. An apparatus for fitting a cover to a body structure, comprising:

a main frame;

a first body-holding assembly mounted in said main frame and incorporating an upwardly open, first holding means which has at least two mutually opposite and mutually spaced sides and which is intended to receive and to hold one end of said body structure, said first holder means being intended to have draped therearound an inverted bag-like cover to be fitted to the body structure;

a second body-holder assembly embodied in said main frame in spaced relationship with said first body-holding assembly and intended to hold the other end of the body structure; and opposing pressing means each being arranged adjacent one of the said first holder sides and being movable in the direction of the geometric extension of the first holding means sides, towards and away from said second body holder assembly and being operative to undrape the cover from the first holder means and to press said cover against respective sides of said body structure during upward movement of said pressing means, at least one of said pressing means being pivotally mounted for engagement with one defining surface of the body structure, said pressing means being arranged to be urged inwardly toward each other by force-generating means.

2. An apparatus according to claim 1, in which said force-generating means comprises devices selected from the group spring means, pneumatic piston-cylinder motors, and hydraulic piston-cylinder motors.

3. An apparatus according to claim 1, in which the first holder means and/or the pressing means can be readily removed from the main frame and replaced with further first holder means and/or pressing means.

4. An apparatus according to claim 1, in which the pressing means are each detachably mounted on mounting means which are adjustable in mutually perpendicular directions in the horizontal plane and preferably also in the vertical plane.

5. An apparatus according to claim 5, in which the main frame incorporates vertically extending elongated guides; a carriage means which is reciprocatingly movable along said guides and which carries the mounting means supporting said pressing means; and means for terminating movement of the carriage means along said guides at given positions thereon.

6. An apparatus according to claim 1, in which the second body-structure holder assembly comprises second holder means having quick-fastener means for rapid attachment and disconnection of said other end of said body structure.

7. An apparatus according to claim 6, comprising means for adjusting the position of the second holder means in at least one direction in the horizontal plane and optionally also in the vertical plane.

8. An apparatus according to claim 1, in which the pressing means each have the form of an inverted U-shaped stirrup assembly, the stirrup part of which has substantially the same width as the body-structure to be covered and/or such form as to follow the contours of the body structure at least partially.

9. An apparatus according to claim 8, in which the second holder assembly and the press-stirrups together with the mounting assemblies and said carriage are arranged to be driven along mutually common guide rods mounted in the main frame, these apparatus assemblies and components being preferably driven by means of double-acting pneumatic or hydraulic piston-cylinder motors.

10. An apparatus according to claim 1, in which means are provided for restricting movement of the second body-structure holder assembly in relation to the first holder means.

11. An apparatus according to claim 1, in which the body structure has the form of a vehicle-seat back-rest, in which apparatus the first body-structure holder means is provided with a bottom surface having mounted thereon positioning devices for guiding head-rest and neck-rest sleeves connected to said back-rest.

12. An apparatus according to claim 1, in which the upwardly open first holder means is stationarily mounted in the main frame and comprises solely a front and a back side; in which said front and back sides of said first holder means are provided with projections and/or recesses intended for co-action with an associated pressing means; and in which a respective pressing means can be swung over the associated side of said first holder means solely in a non-displaced lateral position, wherewith abutments located on the inside of the associated side of the first holder means connects the respective pressing means and swings the same into the opening of said first holder means.

13. A method for fitting a cover to a body structure by means of an apparatus according to claim 1, comprising:

draping an inverted, open-ended cover over the first holder means and the pressing means;

placing one end of a body structure onto the part of the cover lying over the open end of the first holding means while connecting the other end of the body structure to second holder means carried by the second holder assembly;

pressing the body structure to a limited extent into the first holder means with the aid of the second holder assembly, to effect an initial inversion of the originally inverted cover and to draw the cover over said inserted part of the body structure; and moving the pressing means towards the opposite end of the body structure while pressing the cover against the defining surfaces thereof, so as to fully invert the cover and fit said cover around the body structure during continuous relative movement of said cover and said body structure.

14. An apparatus for fitting a cover to a body structure having the form of a vehicle-seat back-rest, comprising:

a main frame;

a first body-holding assembly mounted in said main frame and incorporating an upwardly open, first holding means which has at least two mutually opposite and mutually spaced sides and which is intended to receive and to hold one end of the body structure, said first holder means being adapted for holding an inverted bag-like cover, draped therearound, to be fitted to the body structure;

a second body-holder assembly supported in said main frame in spaced relationship with said first body-holding assembly and adapted for supporting the other end of the body structure;

opposing pressing means each being arranged adjacent one of the said first holder sides and being movable in the direction of the geometric extension of the first holding means sides, towards and away from said second body-holder assembly and being operative to undrape the cover from the first holder means and to press said cover against respective sides of said body structure during upward movement of said pressing means, at least one of said pressing means being pivotally mounted for engagement with one defining surface of the body structure, said pressing means being arranged to be urged inwardly toward each other by force-generating means, and means for moving said second body-holder assembly away from said first body-holding assembly subsequent to fitting the cover on said body structure, whereby said pressing means does not rest against the body structure during a return movement to a starting position.

* * * * *